US009637850B2

(12) United States Patent
Beraud et al.

(10) Patent No.: US 9,637,850 B2
(45) Date of Patent: May 2, 2017

(54) METHOD AND MACHINE FOR SPREADING A FABRIC-TYPE TEXTILE SHEET

(71) Applicant: Hexcel Reinforcements, Dagneux (FR)

(72) Inventors: Jean-Marc Beraud, Rives (FR); Alain Bruyere, Les Avenieres (FR)

(73) Assignee: Hexcel Reinforcements, Dagneux (FR)

( * ) Notice: Subject to any disclaimer, the term of this patent is extended or adjusted under 35 U.S.C. 154(b) by 0 days.

(21) Appl. No.: 14/764,700

(22) PCT Filed: Mar. 6, 2014

(86) PCT No.: PCT/FR2014/050510
§ 371 (c)(1),
(2) Date: Jul. 30, 2015

(87) PCT Pub. No.: WO2014/135806
PCT Pub. Date: Sep. 12, 2014

(65) Prior Publication Data

US 2015/0354119 A1 Dec. 10, 2015

(30) Foreign Application Priority Data

Mar. 8, 2013 (FR) ..... 13 52122

(51) Int. Cl.
*D06C 3/06* (2006.01)
*D06C 15/02* (2006.01)
(Continued)

(52) U.S. Cl.
CPC ..... *D06C 3/06* (2013.01); *D03D 13/008* (2013.01); *D03D 15/0088* (2013.01);
(Continued)

(58) Field of Classification Search
CPC ..... D06C 3/06; D06C 15/00; D06C 15/02; D06C 15/08; D06C 17/02; D06C 2700/10;
(Continued)

(56) References Cited

U.S. PATENT DOCUMENTS 2,093,709 A * 9/1937 Casse ..... A42C 1/02 26/19
2,616,154 A * 11/1952 Boeddinghaus ..... D04H 17/12 28/135
(Continued)

FOREIGN PATENT DOCUMENTS

EP 0589286 3/1994
EP 0756027 1/1997
(Continued)

*Primary Examiner* — Amy Vanatta
(74) *Attorney, Agent, or Firm* — W. Mark Bielawski; David J. Oldenkamp

(57) ABSTRACT

A method for spreading a textile sheet where the sheet is caused to run between at least two rotary rollers, the axes of which extend parallel to each other and substantially perpendicular to the running direction of sheet. The sheet under pressure is caused to pass between at least one pressure generator of the rollers driven into axial oscillation and in phase opposition. At least one pressure generator of the rollers has adjustable pressure values along the generator in order to spread the sheet with a low thickness variability.

20 Claims, 4 Drawing Sheets

(51) Int. Cl.
*D06C 15/00* (2006.01)
*D03D 13/00* (2006.01)
*D03D 15/00* (2006.01)

(52) U.S. Cl.
CPC ..... *D06C 15/00* (2013.01); *D06C 15/02* (2013.01); *D10B 2101/12* (2013.01)

(58) Field of Classification Search
CPC ..... D04H 17/10; D04H 17/12; D03D 13/008; D03D 15/0088
USPC ..... 28/134, 137; 26/18.6, 19, 51, 99
See application file for complete search history.

(56) References Cited

U.S. PATENT DOCUMENTS 2,632,229 A * 3/1953 Mezzera ..... D04H 17/12 28/136
2,645,837 A * 7/1953 Robbins ..... D04H 17/12 28/135
2,683,299 A * 7/1954 Casse ..... D04H 17/12 28/134
2,708,303 A * 5/1955 Walton ..... D04H 17/10 28/122
2,878,778 A * 3/1959 Kusters ..... D06B 15/02 101/22
3,331,113 A * 7/1967 Tugen ..... D04H 17/00 28/124
3,956,806 A * 5/1976 Casse ..... D06C 17/02 26/20
4,070,738 A * 1/1978 Gobel ..... D06C 17/02 26/19
4,124,349 A * 11/1978 Lehmann ..... D06C 15/02 425/363
4,932,107 A 6/1990 Gotoh et al.
5,111,565 A * 5/1992 Beaudreault ..... D06C 3/06 492/20
5,732,748 A 3/1998 Aucagne et al.
2004/0142618 A1 7/2004 Porter
2006/0252325 A1 11/2006 Matsumura
2007/0066171 A1 3/2007 Bystricky et al.
2012/0237707 A1 9/2012 Beraud et al.

FOREIGN PATENT DOCUMENTS

EP 1046666 10/2000
EP 670921 4/2001
FR 2954356 6/2011
WO 94/12708 6/1994
WO 2005/095689 10/2005
WO 2008/119001 10/2008
WO 2009056287 5/2009

* cited by examiner

METHOD AND MACHINE FOR SPREADING A FABRIC-TYPE TEXTILE SHEET

BACKGROUND OF THE INVENTION

1. Field of the Invention

The present invention relates to the technical field of machines allowing homogenization of the thickness of fibrous sheets and/or spreading of such fibrous sheets, in order to obtain lower basis weights. In particular, the invention relates to a method and to a machine allowing homogenization of the thickness of such sheets, as well as to fabrics which may be obtained by applying such a method.

2. Description of Related Art

In the field of composite materials, the applicant was interested in proposing textile fabric sheets having a thickness as homogenous as possible, so as to obtain parts with controlled final mechanical properties. In the case of fabrics, conventionally consisting of an interlacing of warp yarns and of weft yarns, the latter is particularly difficult.

The reinforcements for a composite are exclusively used with addition of resin with different methods. The geometry of the final composite part therefore directly results from the thicknesses of the reinforcement used. It is then clear that the use of thinner reinforcements will provide lighter composite parts and also more performing since they have their fibres better oriented with less ripples. A fact which is less obvious but also true is that these reinforcements, being also used in a sometimes significant stack, it is necessary to reduce to a minimum their variations in thickness in order to make the geometry of the obtained composite part more reliable and robust. As the individual variabilities of the folds will gradually add up, a great variability in thickness of the reinforcement will inevitably cause a strong variability in thickness in the final part during the use of methods such as vacuum infusion.

Various documents are interested in spreading of fabrics, without however mentioning the impact which may have the spreading applied on the thickness and in particular on the thickness deviations which have the obtained spread textile sheets. Mention may be made of documents U.S. Pat. No. 4,932,107, U.S. Pat. No. 5,732,748, EP 670 921, WO2005/095689 and WO 94/12708. It is important to note that a tissue does not leave a weaving machine with homogenous thickness and openness factor on its width. Indeed, the actual principle of weaving induces a shrinkage phenomenon well known to one skilled in the art. This shrinkage is a reduction in the width of the warp sheet before and after weaving. It is due to the interlacing action of the warp and weft yarns. The latter cover a shorter final distance because of their ripples over and under the warp yarns. The result of this is a reduction in the width of the sheet upon leaving the comb of a weaving machine. As this shrinkage is related to the ripples of the weft yarns, it is not homogenous over the width of the fabric by the fact that the weft yarns are more free, close to the edges and less held by less numerous neighbouring warp yarns. As they are less blocked and more free, these edge of yarns therefore ripple more, the result of this is then a larger thickness and generally a larger openness factor. The thickness difference between the edges and the medium increase with the basis weight of the fabric.

It should also be noted that the over-thickness phenomenon of the edges is very locally enhanced by the use of generally thermoplastic selvage yarns used on the edges of the fabric for blocking the last warp yarns.

All the fabrics proposed in the prior art, which are spread out after their weaving, because of the applied spreading technique necessarily have significant thickness variation. In particular, in document U.S. Pat. No. 4,932,107, no mention of any width of the fabric, of the average width of the warp and weft yarns after spreading and of homogeneity of the openness factor on the fabric. Now, all these elements determine the more or less homogenous thickness of the fabric obtained after spreading. If the examples proposed in this patent are considered, if a tension of 200 g/cm is applied on a fabric with a width of 1.5 m, the value of the tension on the roller will be 150×200=30,000 i.e. 30,000 g. This value is sufficient for generating flexure of the rollers preventing the obtaining of a parallelism between the axes of the rollers and therefore a homogeneous pressure on the fabric, because of a higher pressure on the edges. There results a limitation of the width of the fabric to be processed in connection with the diameter of the rollers and of their length. In order to attempt to circumvent this difficulty, an increase in the diameter of the rollers may be contemplated for limiting flexure, but in this case, the inertia of the latter will then become significant and the energy required for obtaining the amplitude and the frequency will increase in proportion. Moreover, it may be noted that patent U.S. Pat. No. 4,932,107 applied in its example 3B, 2 rollers with the diameter of 125 mm with a single upper vibrating roller with a diameter of 60 mm, which on the one hand does not give the possibility of obtaining satisfactory spreading and on the other hand homogenization of the thickness. In a more general way, all the techniques for spreading fabrics described in the prior art do not give the possibility of adapting to the initial differences in thickness which the fabric has and therefore do not give the possibility of obtaining satisfactory spreading and homogenization of the thickness.

There also exist fabrics made in two steps, the first step being the formation of sheets with low basis weight consolidated via a polymeric binder, and then producing the interlacing for forming a fabric. Such fabrics because of the preliminary consolidation of the sheets provide lesser possibilities in terms of deformability during their applications. Further, the polymeric binders used may not be compatible with the sheet of requirements under hygrothermal stress of the final composite part.

SUMMARY OF THE INVENTION

In this context, the invention proposes to react to the problems mentioned above and encountered in the prior art and to provide a novel method and a novel machine giving the possibility of simply controlling the thickness of the obtained textile sheet following a spreading operation, so as to obtain a low thickness variability, and this even on large widths of sheet.

In this context, the invention relates to a method for spreading a textile sheet including at least warp yarns, according to which:

- the sheet is caused to run between at least two rotary rollers, the axes of which extend parallel with each other and are substantially perpendicular to the running direction of the sheet,
- the sheet is passed under pressure between at least one pressure generator for the rollers driven into axial oscillation and opposed in phase.

According to the invention, a pressure generator for the rollers is produced with adjustable pressure values along said generator for spreading the sheet with low thickness variability.

Within the scope of the invention, it is also possible to ensure the application of a uniform pressure on the sheet so as to obtain a uniform thickness regardless of the width of the sheet. The rollers thus modulate the applied pressure between the centre and the ends of the sheet, by taking into account the different thicknesses of the sheet so as to apply a uniform pressure on the material along the pressure generator. Typically, the pressure applied at the centre of the sheet is greater than that applied on its edges so as to take into account the upper thickness of the sheet on its edges with respect to its central portion.

According to a preferred embodiment, one of the rollers is made to be flexible and the other one rigid and localized supports distributed along the axis of the roller are exerted on this flexible roller, substantially perpendicularly to its axis and with adjustable values for producing the generator with adjustable pressure values. The flexible roller may thus position itself automatically without any stress and thereby modulate the pressure applied on the sheet. In this case, preferably, the method inter alia consists of adjusting the position of the localized supports along the axis of the flexible roller and/or distributing the localized supports regularly along the axis of the flexible roller.

According to a preferred embodiment which may be combined with the previous one, the method inter alia consists of distributing the localized supports at most over the whole width of the textile sheet.

According to another preferred embodiment which may be combined with the previous ones, the method inter alia consists of causing the textile sheet to pass over the periphery of the flexible roller between two pressure generators with adjustable localized pressure values of both rigid rollers synchronously driven in rotation and in oscillation. In this case, preferably, the method consists of causing the textile sheet to pass between ⅙ and ⅓ of the periphery of the flexible roller. It is thus possible to do without the applied tension on the running textile sheet. Further, this facilitates obtaining an adjustable pressure on the textile sheet all along both pressure generators between the textile sheet and the rigid rollers, given that this method for the passing of the textile sheet which no longer covers the rollers as in patent U.S. Pat. No. 4,932,107 thus allows addition of a series of rigid supports to both rigid rollers thereby avoiding any flexure of the latter. On the other hand, this passing method also facilitates the positioning of the localized supports on the flexible roller.

According to another preferred embodiment which may be combined with the preceding ones, the method comprises the heating of the textile sheet during its passing between the pressure generator(s).

According to another preferred embodiment which may be combined with the previous ones, the method consists of bringing as a textile sheet, a fabric including warp yarns and weft yarns each consisting of a set of filaments which may freely move relatively to each other within said yarn, the spreading being produced on the warp yarns and on the weft yarns.

The present invention also relates to a machine for spreading a textile fabric consisting of at least warp yarns, including:

- at least two rotary rollers, the axes of which extend parallel with each other and perpendicularly to a pressure generator, delimited between both rollers,
- a rotation motor-drive for at least one roller,
- and a system for driving the rollers in axial oscillation with phase opposition.

According to the invention, the machine includes a system for producing the pressure generator with adjustable pressure values distributed along said generator, for spreading the textile fabric with low thickness variability.

The machine according to the invention comprises either one, or even all the features below when they do not exclude one from the other:

- the system for producing the pressure generator includes from among rotary rollers, a flexible roller and a series of localized supports with adjustable pressure, distributed along the axis of the flexible roller and acting on the flexible roller supported by at least one rigid roller,
- the localized supports are equipped with a device for adjusting their position along the axis of the flexible roller,
- the localized supports exert their pressure on the flexible roller, via rolling members with axial displacement,
- the flexible roller delimits with two rigid rollers, the axes of which extend parallel with each other, two pressure generators with adjustable localized pressure values, both of these generators being separated between ⅙ and ⅓ of the periphery of the flexible roller,
- the rollers have a diameter comprised between 30 mm and 60 mm,
- the machine includes for each rigid roller, a series of rigid supports each including a cradle attached to a chassis and having two supporting branches each equipped with a rolling member for a rigid roller, having a rotary movement and a translational movement along the axis of the rigid rollers,
- the system for driving the rollers into axial oscillation and in phase opposition includes a motor synchronously driving by means of a transmission, two camshafts shifted by 180°, one of which acts on one of the ends of the flexible roller and the other one acts on one of the ends of the rigid roller(s), the other end of the rollers being urged by an elastic system; this gives the possibility of ensuring perfect control of the amplitude and of the operation in phase opposition between the flexible roller and both rigid rollers,
- the machine includes a system for lifting the flexible roller, the ends of which are provided with plates on which acts the elastic system and on the other one of which acts the camshaft,
- the machine includes a system for heating the textile sheet upon passing the textile sheet between the pressure generators.

With such methods and devices, it is possible to produce fabrics consisting of warp yarns and of weft yarns, having a low thickness variation, characterized by either one of the combinations of the following characteristics:

- a basis weight greater than or equal to 40 g/m$^2$ and less than 100 g/m$^2$ and a thickness standard deviation measured on a stack of three identical fabrics deposited on each other and along the same direction which is less than or equal to 35 m,
- a basis weight greater than or equal to 100 g/m$^2$ and less than or equal to 160 g/m$^2$ and a thickness standard deviation measured on a stack of three identical fabrics deposited on each other and along the same direction which is less than or equal to 50 μm,
- a basis weight greater than 160 g/m$^2$ and less than or equal to 200 g/m$^2$ and a thickness standard deviation measured on a stack of three identical fabrics deposited on each other and along the same direction which is less than or equal to 60 μm, or
- a basis weight greater than 200 g/m$^2$ and less than or equal to 400 g/m$^2$ and a thickness standard deviation measured on a stack of three identical fabrics deposited on each other and along the same direction which is less than or equal to 90 μm.

In such fabrics, the warp yarns and/or the weft yarns consist of a set of filaments, said filaments may freely move relatively to each other within a same yarn. This is why such fabrics may be obtained by means of the method according to the invention. Unlike prior techniques, the method according to the invention provides access to such fabrics having such a combination of features. Obtaining such fabrics with a width of at least 100 cm, notably with a width from 100 to 200 cm, is possible. The fabrics according to the invention may therefore have a great width and a very great length, for example approximately equivalent to the length of the available yarns, i.e. several hundred or thousands of meters.

The fabrics proposed within the scope of the invention, because of their lower thickness variability, will give composite parts with a better controlled geometry and will lead to a more robust global manufacturing method.

By thickness standard deviation, is meant the quadratic average of the deviations to the mean, i.e.:

$$\sqrt{\frac{1}{n}\sum_i (x_i - \bar{x})^2}$$

with:

n=number of values of measurements of the thickness of the stack of three identical fabrics and oriented in the same direction, i.e. the warp yarns on the one hand, and the weft yarns on the other hand are oriented in the same direction within the stack, xi=a measurement value of the thickness of the stack of the three identical fabrics, $\bar{x}$=arithmetic mean of the thickness measurements of the stack of three identical fabrics.

As the measured fabric unit folds become so thin, it appeared to be more representative to measure the thickness standard deviation on a stack of 3 folds.

Within the scope of the invention, the standard deviation may be obtained on a stack of three folds of a same fabric deposited on each other and oriented in the same direction and placed under a pressure of 972 mbars+/−3 mbars, and notably from 25 one—off thickness measurements distributed over a surface of 305×305 mm, with for example one of the sides of the square which extends parallel to the warp yarns of the fabric. The method described in the examples may be used.

Advantageously, the fabrics defined within the scope of the invention consist of warp yarns identical with each other and weft yarns identical with each other, and preferably warp yarns and weft yarns which are all identical. In particular, the fabrics defined within the scope of the invention consist of, preferably by at least 99% by mass, or even exclusively consist of multi-filament reinforcement yarns, notably glass, carbon or aramide yarns, carbon yarns being preferred. As examples of fabrics according to the invention, mention may be made of those having an architecture of the web type otherwise called taffeta, twill, a basket weave, or satin.

In particular, the invention allows the manufacturing:

of fabrics which have a basis weight greater than or equal to 40 g/m$^2$ and less than 100 g/m$^2$, a thickness standard deviation measured on a stack of three identical fabrics deposited on each other and along the same direction which is less than or equal to 35 μm and an average openness factor from 0 to 1%. Advantageously, such fabrics have a variability of openness factor from 0 to 1%. Within the scope of the invention, the obtained spreading gives the possibility of obtaining such fabrics with yarns, and in particular carbon yarns, having a titer from 200 to 3,500 Tex, and preferably from 200 to 800 Tex, of fabrics which have a basis weight greater than or equal to 100 g/m$^2$ and less than or equal to 160 g/m$^2$, a thickness standard deviation measured on a stack of three identical fabrics deposited on each other and along the same direction which is less than or equal to 50 μm and an average openness factor from 0 to 03%. Advantageously, such fabrics have a variability of openness factor of at most 0.5%. Within the scope of the invention, the obtained spreading gives the possibility of obtaining such fabrics with yarns, and in particular carbon yarns, having a titer from 200 to 3,500 Tex, and preferably from 400 to 1,700 Tex, of fabrics which have a basis weight greater than 160 g/m$^2$ and less than or equal to 200 g/m$^2$, a thickness standard deviation measured on a stack of three identical fabrics deposited on each other and along the same direction which is less than or equal to 60 μm and an average openness factor from 0 to 0.5%. Advantageously, such fabrics have a variability of openness factor of at most 0.5%. Within the scope of the invention, the obtained spreading gives the possibility of obtaining such fabrics with yarns, and in particular carbon yarns, having a titer from 200 to 3,500 Tex, and preferably from 400 to 1,700 Tex, of fabrics which have a basis weight greater than 200 g/m$^2$ and less than or equal to 400 g/m$^2$, a thickness standard deviation measured on a stack of three identical fabrics deposited on each other and along the same direction which is less than or equal to 90 μm and an average openness factor from 0 to 0.1%. Advantageously, such fabrics have an openness factor variability of at most 0.1%. Within the scope of the invention, the obtained spreading gives the possibility of obtaining such fabrics with yarns, and in particular carbon yarns, having a titer from 200 to 3,500 Tex and preferably from 800 to 1,700 Tex.

The openness factor may be defined as the ratio between the surface area not occupied by the material and the observed total surface area, the observation of which may be made from the top of the fabric with an illumination from below the latter. The openness factor (OF) is expressed in percentages. For example it may be measured according to the method described in the examples.

By openness factor variability, is meant the maximum difference in absolute value obtained between a measured openness factor and the average openness factor. The variability is therefore expressed in % like the openness factor.

The average openness factor may be obtained, for example from 60 openness factor measurements distributed over a surface of 305×915 mm of fabric. The distribution may for example be achieved, by distributing ⅓ of the openness factor measurements over a first third of the width of the fabric, ⅓ of the openness factor measurements on the second third of the fabric width corresponding to its central portion and ⅓ of the openness factor measurements on the third portion of the fabric width.

By average openness factor, is meant the arithmetic mean of the 60 measured openness factor (OF) values.

Mean openness factor=(OF1+OF2+OF3+ . . . +OF60)/60

The detailed description which follows, with reference to the appended Figures allows the invention to be better understood.

DETAILED DESCRIPTION OF THE INVENTION

Figure 1:
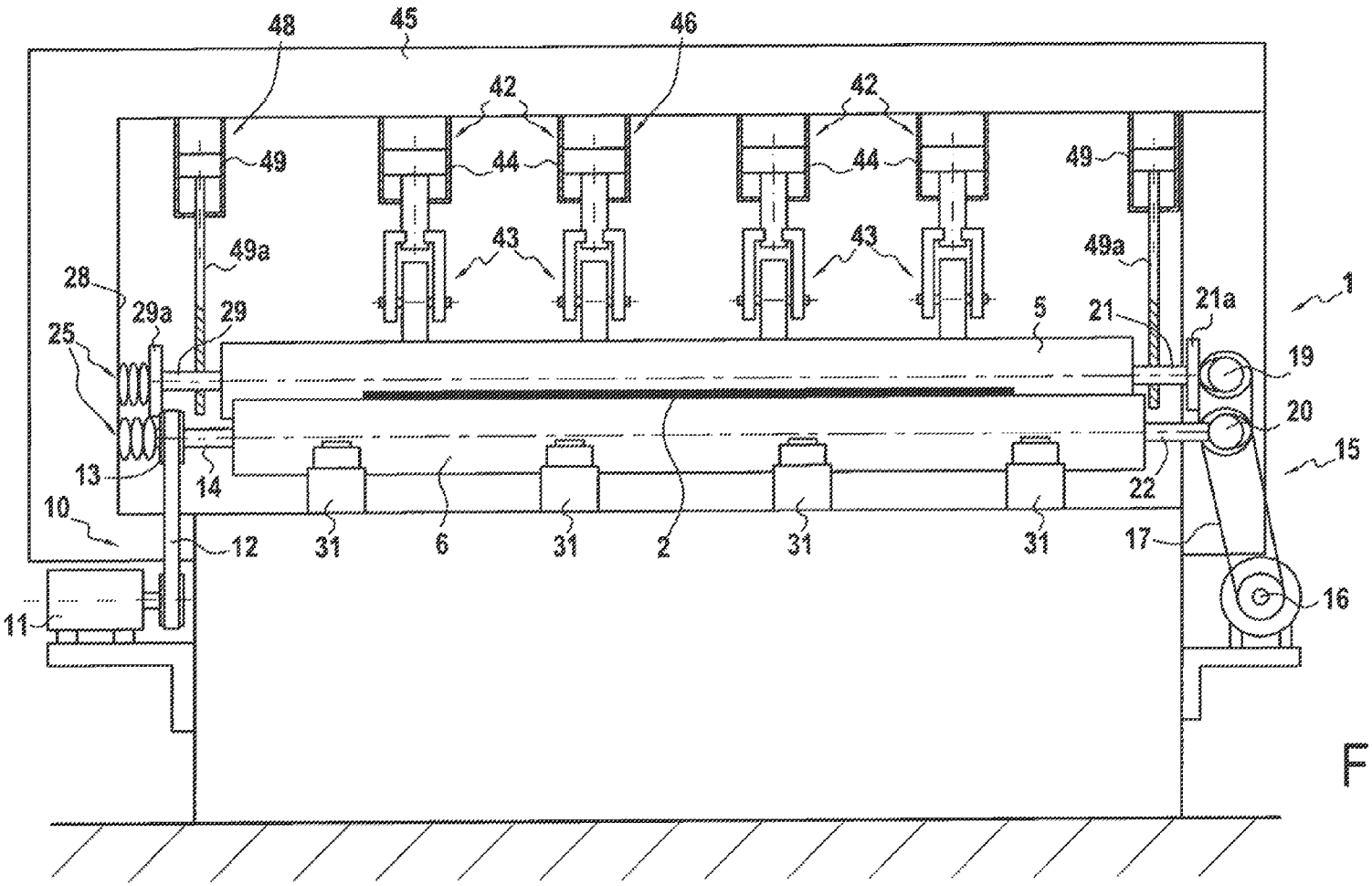
FIG. 1 is a schematic front view of a spreading machine according to the invention.
Figure 2:
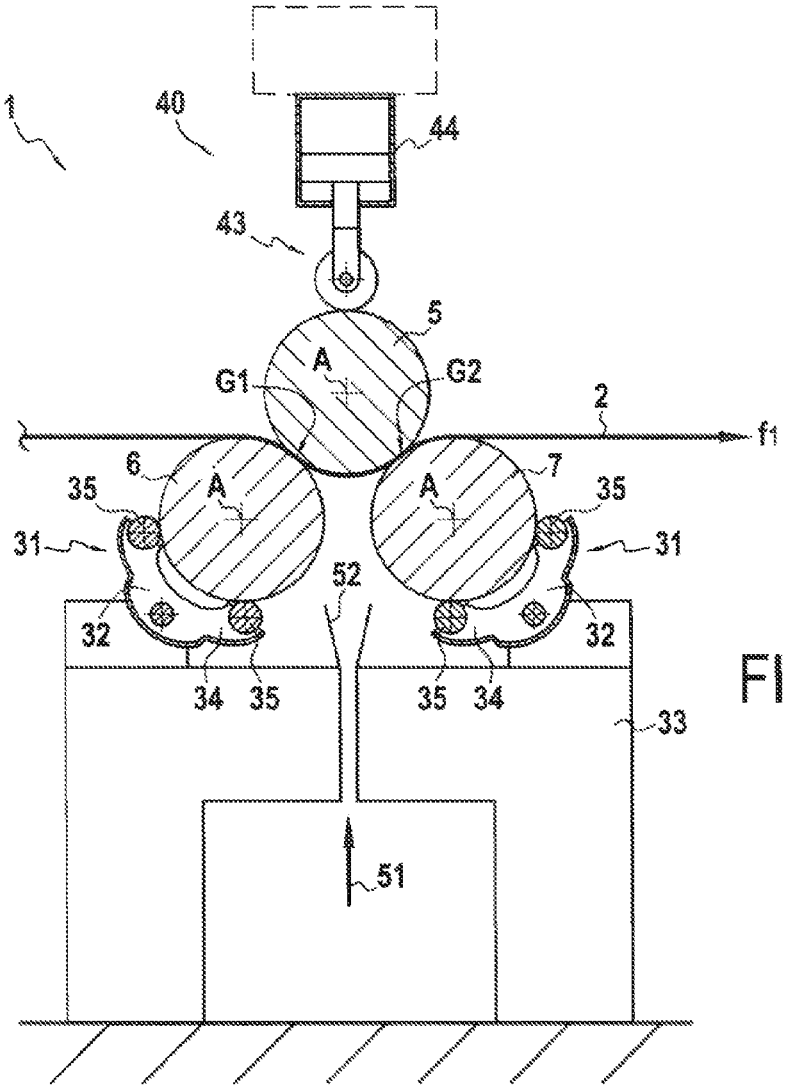
FIG. 2 is a transverse sectional view of the spreading machine illustrated in FIG. 1.
Figure 3:
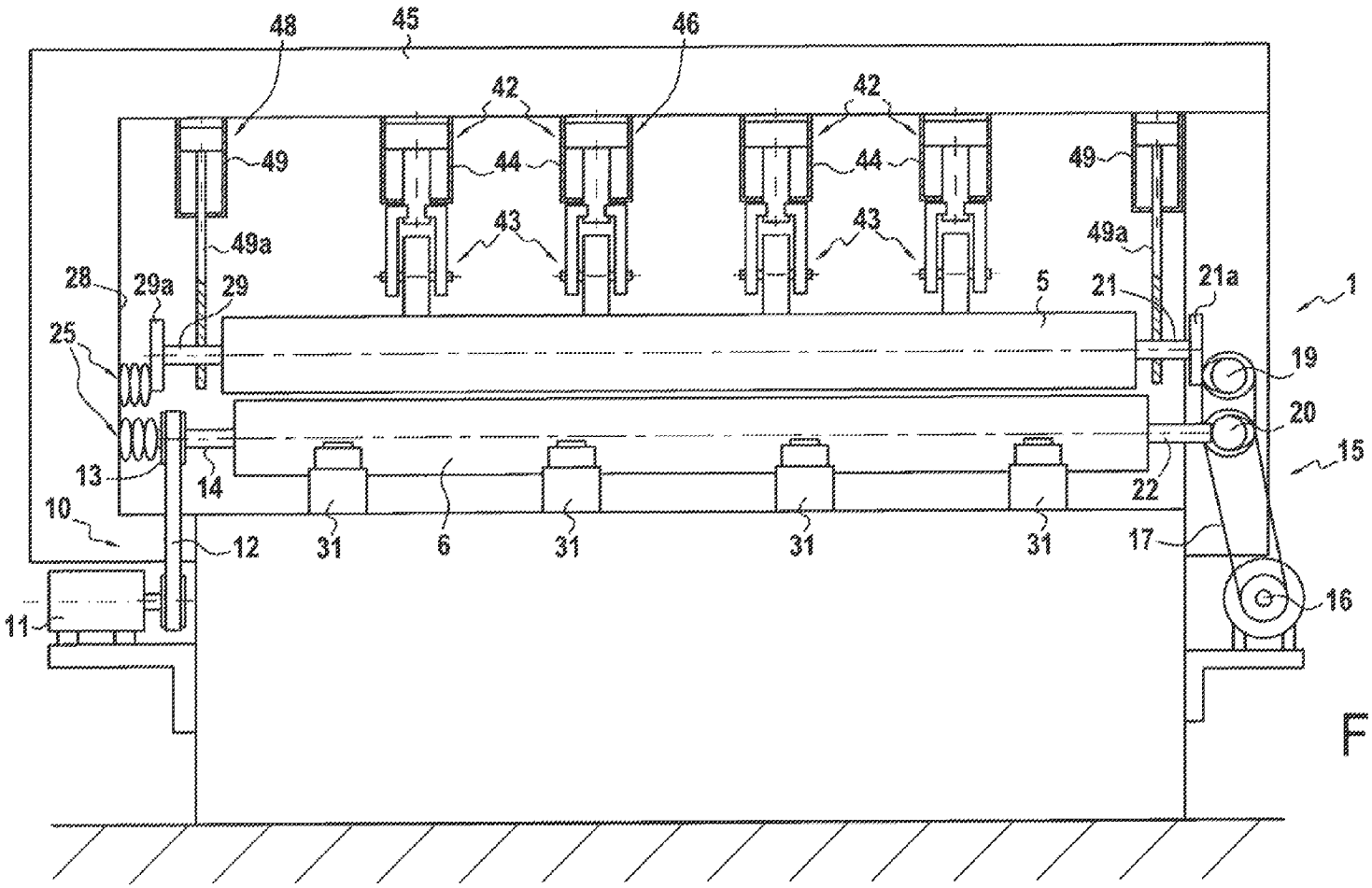
FIG. 3 is a schematic front view of a spreading machine according to the invention, in the raised position of the flexible roller.

FIGS. 1 to 3 schematically illustrate an exemplary embodiment of a spreading machine 1 according to the invention, adapted for spreading with a low thickness variability, a textile sheet 2 including at least warp yarns 3. Conventionally, by textile sheet, is meant a sheet material consisting of yarns and by warp yarns, yarns extending along the running axis of the sheet on the machine. The textile sheets may be one-directional or fabrics. In the example illustrated in FIGS. 4A and 4B, the sheet 2 is a fabric including warp yarns 3 and weft yarns 4, each warp 3 and weft 4 yarn consisting of a set of filaments t. According to a preferred embodiment, the spreading machine 1 according to the invention, is placed at the outlet of a weaving machine and at the inlet of a system for winding up the sheet. It may also be provided that the sheet to be spread out is from an unwinding system and which is not directly positioned in line with a weaving machine.

The spreading machine 1 includes at least one first 5 and one second 6 rotary rollers and in the illustrated example, a third rotary roller 7. The rotary rollers 5, 6 and 7 have axes A extending parallel with each other and perpendicularly to the running direction f1 of the sheet 2 or perpendicularly to the warp yarns 3. The first roller 5 and the second roller 6 delimit between them a first pressure generator G1 for the sheet 2 passing between the first and second rollers 5, 6. Also, in the example illustrated in the drawings, the first roller 5 and the third roller 7 delimit between them a second pressure generator G2 for the sheet 2 passing between the first and third rollers 5, 7. Of course, the length of the rollers is adapted to the width of the sheet 2 to be spread out so as to have a greater length than the width of the sheet 2. Typically, the length of the rollers is comprised between 1 m and 2 m.

According to an advantageous feature of the invention, the rollers 5, 6 and 7 are positioned in such a way that both pressure generators G1 and G2 are separated between ⅙ and ⅓ of the periphery of the first roller 5. In other words, the sheet 2 is in contact with the first roller 5 exclusively between ⅙ and ⅓ of its periphery.

According to a preferred alternative embodiment, the second 6 and third 7 rollers are positioned side by side in a horizontal plane, while the first roller 5 is positioned in the middle and above the second 6 and third 7 roller.

The spreading machine 1 according to the invention also includes a motor drive 10 for ensuring synchronous driving into rotation around their axes A and along a same direction of rotation, second 6 and third 7 rollers. In the illustrated example, the motor-drive 10 includes an electric motor 11 controlled for synchronously controlling the speed of rotation of the second 6 and third 7 rollers. The output shaft of the electric motor 11 cooperates with a transmission belt 12 which drives into rotation pulleys 13 supported by shafts 14 mounted so as to be axially secured to the first end of the second 6 and third 7 rollers.

In the illustrated example, the first roller 5 is not driven into rotation by the motor-drive 10. The first roller 5 is driven into rotation by the running force of the sheet 2 and by the rollers 6, 7. Of course, it is possible to envision that the motor-drive 10 also drives into rotation the first roller 5.

The spreading machine 1 according to the invention also includes a system 15 for driving the rollers 5, 6 and 7 into axial oscillation each along its axis A. More specifically, the driving system 15 allows axial oscillation of the first roller 5 in phase opposition with respect to the second and third rollers 6 and 7 which are perfectly synchronized in axial oscillation. In the example illustrated in the drawings, the driving system 15 includes an electric motor 16 synchronously driving, by means of a transmission 17 such as a belt, first 19 and second 20 camshafts giving the possibility of exerting an axial force on the rollers. As this clearly emerges from FIG. 1, the cams of the camshafts 19 and 20 are angularly shifted from each other by a value equal to 180°.

The first camshaft 19 acts on the second end of the first roller 5 and more specifically on the transverse face of a shaft 21 axially extending from the first roller 5. According to an advantageous alternative embodiment, the first camshaft 19 acts on the shaft 21, via a plate 21*a* borne by the shaft 21. Thus, even when the first roller 5 is moved vertically, the camshaft 19 continues to exert an axial force on the shaft 21 as this will be explained in more detail in the continuation of the description.

The second camshaft 20 acts on the second end of the second roller 6 and in the illustrated example, of the third roller 7 also. According to this illustrated alternative, the second and third rollers 6 and 7 are axially equipped, at their second end, with shafts 22 in contact, through their transverse face, with the camshaft 20 which ensures synchronized axial oscillation of the second and third rollers 6 and 7. Thus, the second and third rollers 6 and 7 have a perfectly synchronized axial oscillation.

The first ends of the first, second and third rollers 5, 6 and 7 are urged by an elastic system 25 which will compensate for the action exerted by the camshafts 19, 20 on the second ends of the first, second and third rollers 5, 6 and 7. In the illustrated exemplary embodiment, the elastic system 25 includes stacks of Belleville washers interposed between a support 28 on the one hand, and each shaft 14 and a shaft 29 on the other hand extending axially from the first end of the first roller 5. According to an advantageous alternative embodiment, a stack of Belleville spring washers 25 acts on the shaft 29 via a plate 29*a* borne by the shaft 29. Thus, even when the first roller 5 is moved vertically, the stack of Belleville spring washers 25 continues to exert an axial force on the shaft 29 as this will be explained in more detail in the continuation of the description.

The driving system 15 as described above gives the possibility of ensuring perfect control of the amplitude of operation in phased opposition between the first roller 5 on the one hand and the second and third rollers 6, 7 on the other hand. Moreover, this solution gives the possibility of guaranteeing the desired movement of the rollers in spite of wear phenomena due to suppression of the mechanical play between camshafts and the rollers. Of course, the axial vibration frequency is adjustable for example from 5 to 50 Hz via the adjustment of the electric motor 16. Typically, the amplitude of the axial oscillation of the rollers is of the order of 0.5 mm.

The spreading machine 1 also includes for the second and third rollers 6 and 7, a series of rigid supports 31 giving the possibility of supporting without any flexure, the rollers while allowing their movements of rotation and oscillation. In the illustrated example, each rigid support 31 includes a fork or a cradle 32 rigidly attached to a chassis 33 preferably rigidly anchored to the ground. Each fork or cradle 32 thus has two supporting branches 34 each equipped with a rolling member 35 for a roller 6, 7, which may both receive the movement of rotation and the movement of oscillation. In the example illustrated in FIG. 1, four rigid supports 31 support the rollers. Of course, the number of rigid supports 31 may be different notably depending on the length of the rollers.

According to the invention, the spreading machine 1 includes a system 40 for producing the first pressure generator G1 and in the illustrated example also the second pressure generator G2, with adjustable pressure values distributed along the generator(s), for spreading the sheet 2 with low thickness variability. In other words, the system 40 allows modulation of the pressure at will, along these pressure generators G1, 62 in order to apply uniform pressure on the sheet while taking into account initial thickness differences of the sheet, with view to spreading the sheet with a low thickness variability.

According to a preferred embodiment, the system 40 includes as a first roller 5, a flexible roller and a series of localized supports 42 with adjustable pressure, spread along the axis of the flexible roller 5 and acting on the flexible roller 5. As this more specifically emerges from FIG. 2, the first roller 5 is mounted in a flexible way along its axis A in the sense that it is free of any guiding bearing at both of its ends. The flexible roller 5 may thus position itself automatically, without any stress, between the two other rollers 6 and 7. Conversely, the second and third rollers 6 and 7 are rigid since they are supported without any flexure by the chassis 33. Each localized support 42 exerts its pressure on the flexible roller 5, via rolling members 43 with axial displacement. Thus, each localized support 42 is able to exert a substantially vertical pressure force perpendicular to the axis of the flexible roller 5 while accepting the movement of rotation and axial oscillation of the flexible roller 5. For example, each localized support 42 is a pressure actuator 44, the rod of which is equipped with a rolling member 43. Each pressure actuator 44 is connected to a control unit not shown but known per se, allowing adjustment of the pressure exerted on the flexible roller 5. In the example illustrated in FIG. 1, the spreading machine 1 includes four pressure actuators. Of course, the number of pressure actuators 44 may be different.

According to an advantageous alternative embodiment, the localized supports 42 are equipped with a device 46 for adjusting their position along the axis of the flexible roller 5. Thus, the localized supports 42 may be moved independently of each other along the axis of the flexible roller 5 so as to be able to exert their pressure force in all the selected locations of the sheet 2. In the illustrated example, the actuators 44 are slidably mounted along a gantry 45 overhanging from a distance the flexible roller 5. Each actuator 44 is placed in a fixed position by means of a system for locking the body of the actuator on the frame, not shown, but of all types known per se.

According to an advantageous alternative embodiment, the spreading machine 1 according to the invention includes a system 48 for raising the flexible roller 5 in order to allow operations for placing the sheet 2 between the flexible roller 5 and the rigid rollers 6, 7. In the illustrated example, the raising system 48 includes two actuators 49 attached through their bodies onto the gantry 45 and the rods 49*a* of which act on the shafts 21 and 29 extending from both ends of the flexible roller 5. It should be noted that the elastic system 25 acts on the shaft 29 of the flexible roller 5 while the camshaft 19 continues to exert an axial force on the shaft 21, even during operations for raising the flexible roller 5 because of the presence of the end plates 21*a* and 29*a*, as illustrated in FIG. 3.

According to an advantageous embodiment characteristic, the spreading machine according to the invention includes a system 51 for heating the sheet and the rollers during the passing of the sheet between the pressure generators. The heating system 51 includes a nozzle 52 for supplying the hot air produced by a hot air production unit not shown but known per se. This supply nozzle 52 opens between both rigid rollers 6 and 7 by directing the hot air flow towards the flexible roller 5 along its portion located between both pressure generators G1 and G2. Typically, a heating unit of the Leister type is used for ensuring heating of the sheet 2 and of the rollers up to a temperature of 80° C.

In the foregoing description, the spreading machine 1 includes a flexible roller 5 and two rigid rollers 6, 7 defining two pressure generators G1, G2. Of course, the spreading machine 1 according to the invention may have a similar operation by applying a single rigid roller 6 defining with the flexible roller 5, a single pressure generator G1. Moreover, the spreading machine 1 described above, includes as localized supports 42, actuators exerting a pressure force on the flexible roller 5. Other solutions may be contemplated with view to producing pressure generators with adjustable pressure values.

The spreading machine 1 according to the invention is particularly adapted for spreading warp yarns 3 and also weft yarns 4 when the sheet 2 is a fabric.

The application of a spreading method directly results from the foregoing description.

According to the method for spreading a sheet 2:

- the sheet 2 is caused to run between at least two rotary rollers 5, 6-7, the axes A of which extend parallel with each other and are substantially perpendicular to the running direction of the sheet,
- the sheet under pressure is passed between at least one pressure generator G1 of the rollers driven into axial oscillation and in phased opposition,
- and at least one pressure generator G1 of the rollers 5, 6-7 is produced with adjustable pressure values along said generator so as to spread the sheet 2 with a low thickness variability.

It should be understood that it is thus possible to modulate the pressure between the centre and the edges of the sheet 2 so that the flexible roller 5 applies a uniform pressure on the sheet 2 taking into account the thickness differences of the sheet. Of course, it may be contemplated that the pressures be identical along the contact generator.

During this spreading operation, the sheet 2 is maintained under tension with a substantially constant small value, by means of suitable systems for tensioning the sheet 2, located on its travel upstream and downstream from the pressure rollers and designed for compensating the forces which may for example appear upstream, at the outlet of the weaving machine and downstream, at the winder of the sheet.

According to a preferred alternative embodiment, one of the rollers 5 is made flexible and the other one 6-7 made rigid and, localized supports 42 distributed along the axis of the roller and with adjustable values are exerted on this flexible roller, substantially perpendicularly to its axis in order to produce the generator with adjustable pressure value. Thus, different pressure values are exerted in different locations of the pressure generator in order to ensure proper spreading of the yarns of the sheet 2.

According to an advantageous feature of the invention, the method consists of adjusting the position of the localized supports 42 along the axis of the flexible roller so as to selectively choose the locations where the pressures are to be applied. For example, it is possible to distribute the localized supports 42 in a regular way along the axis of the flexible roller. However, the adjustment consists of distributing the localized supports 42 at most over the whole width of the sheet 2. Indeed, regardless of the length of the sheet, the localized supports 42 should always act inside the delimited area overhanging the width of the sheet 2. In other words, the localized supports 42 should not act on an area of the flexible roller which is never in contact with the sheet 2. According to a preferred exemplary embodiment, the position of the actuators which are close to the edges of the sheet are positioned so as to be at a distance of at least 50 mm from these edges. Typically, the actuators which are close to the edges of the sheet are positioned so as to be at a distance of 150 mm from these edges. The actuators located between both of these actuators close to the edges are positioned so that all the actuators are regularly spaced apart. For example, the number of actuators is selected so that the distance between two neighbouring actuators is of at least 300 mm. According to a preferred embodiment alternative, the sheet 2 is caused to pass over the periphery of the flexible roller 5 between two pressure generators G1, G2 with adjustable localized pressure values. Both of these generators are delimited between the flexible roller 5 and two driven rigid rollers 6, 7, synchronously, in rotation and in oscillation. Advantageously, the sheet 2 is caused to pass over the flexible roller 5, between ⅙ and ⅓ of the periphery of the flexible roller 5.

According to a feature of the invention, the sheet 2 and the rollers are heated during its passing between the pressure generator(s).

It emerges from the foregoing description that the invention gives the possibility of spreading the warp yarns of a one-directional sheet of warp yarns or interlaced warp yarns and/or weft yarns of a fabric. The spread out textile sheets will at least partly be formed of reinforcing fibres of the carbon, glass or aramide type which conventionally consists of a set of filaments extending along the direction of the yarn.

Advantageously, within the scope of the invention, the textile sheet to be spread out will either exclusively consist of a one-directional sheet of warp yarns, or a fabric consisting of interlacing of warp yarns and weft yarns. Of course, in every case, the yarns are not secured to each other by any binder or mechanical binding method of the sewing or knitting type which would hamper their displacement relatively to each other and would not allow them to be spread out. In the case of a fabric, the warp yarns and the weft yarns are only held together by the weaving. In particular, in the case of a textile sheet consisting of a one-directional sheet of warp yarns, the latter will consist of carbon, glass or aramide yarns. In the case of a fabric consisting of an interlacing of warp yarns and weft yarns, it is either possible to spread out the weft yarns exclusively which, in this case, will be interlaced with yarns playing the role of a support such as yarns in a thermoplastic material, or to spread out both the warp yarns and the weft yarns. In every case, the yarns intended to be spread out in the method according to the invention consist of a set of filaments which may freely move relatively to each other, and in particular of carbon yarns. Such yarns may initially have a circular section or preferably rectangular section but at the outlet of the method according to the invention, they will have a rectangular section following the application of pressure forces. In order to allow their spreading out, the yarns to be spread out will neither be impregnated, nor coated, nor associated with any polymeric binder which would hamper free displacement of the filaments relatively to each other. The yarns to be spread out are nevertheless most often characterized by a mass standard sizing level which may represent at most 2% of their mass.

A carbon yarn consists of a set of filaments and generally includes from 1,000 to 80,000 filaments, advantageously from 12,000 to 24,000 filaments. More preferably, within the scope of the invention, carbon fibres of 1 to 24K, for example, 3K, 6K, 12K or 24K, and preferentially 12 and 24K are used. The carbon yarns present within one-directional sheets, have a titer of 60 to 3,800 Tex, and preferentially from 400 to 900 tex. The one-directional sheet may be produced with any type of carbon yarns, for example high resistance (HR) yarns for which the tensile modulus is comprised between 220 and 241 GPa and the tensile breaking stress of which is comprised between 3,450 and 4,830 MPa, yarns of intermediate modulus (IM) for which the tensile modulus is comprised between 290 and 297 GPa and the tensile breaking stress of which is comprised between 3,450 and 6,200 MPa and high modulus (HM) yarns, for which the tensile modulus is comprised between 345 and 448 GPa and for which the tensile breaking stress is comprised between 3,450 and 5,520 Pa (according to the "ASM Handbook", ISBN 0-87170-703-9 ASM International 2001).

Figure 4A:
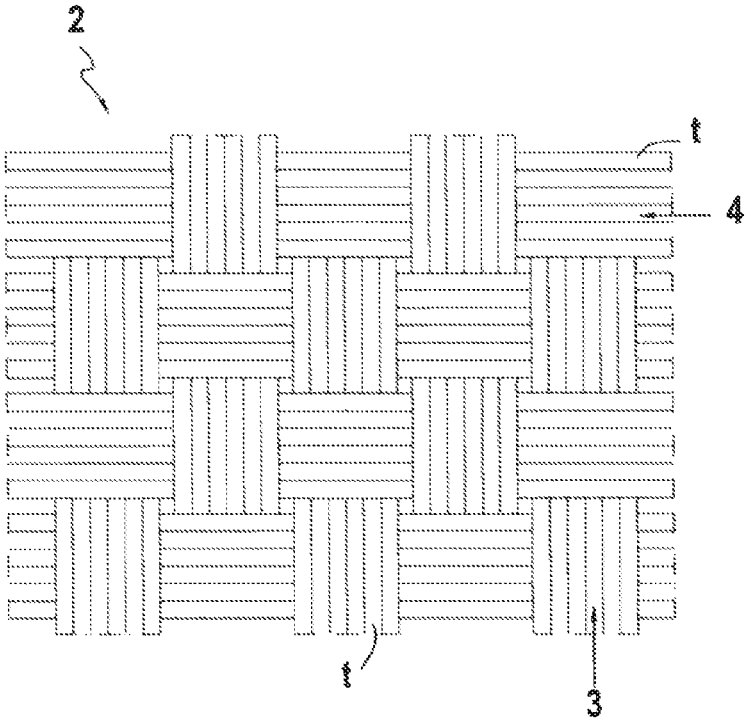
FIGS. 4A and 4B are planar views of an example of a fabric illustrated before and after spreading, respectively.

FIG. 4A schematically shows a fabric before its spreading out consisting of an interlacing of warp yarns and weft yarns with a slightly different width because of the weaving. These may notably be 3K carbon yarns. Each of the warp yarns and weft yarns consist of a set of filaments. Initially, the openness factor of the textile fabric is 4%.

Figure 4B:
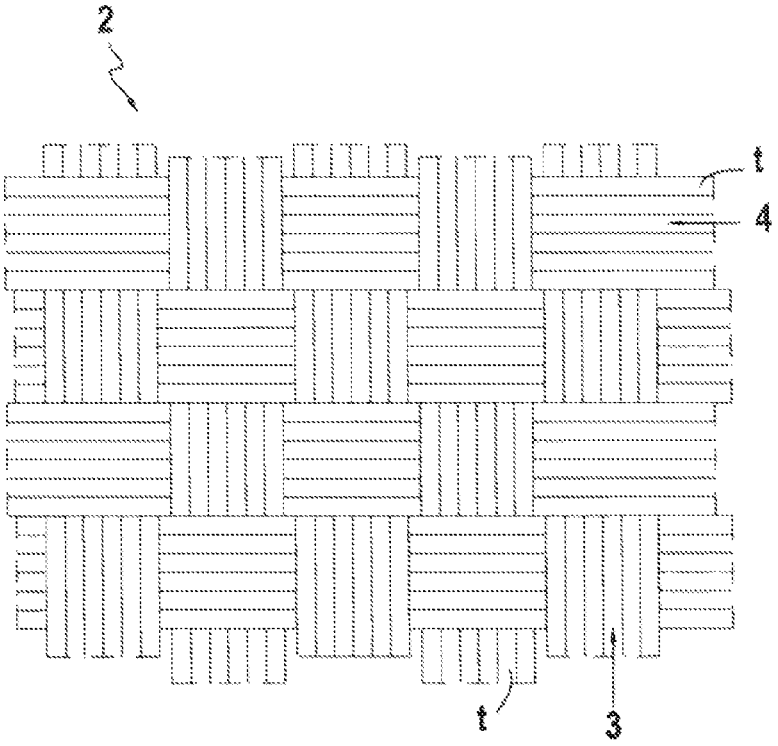

FIG. 4B illustrates the fabric obtained after applying the spreading method according to the invention. This fabric has an OF level of 0% and warp and weft yarns of different width.

Within the scope of the invention, it is possible that the textile sheet before being subject to the method according to the invention has a zero or non-zero openness factor. When initially the openness factor is non-zero, applying the method according to the invention causes a reduction of the openness factor which accompanies the obtaining of homogenization of the thickness of the textile sheet. Whether initially the openness factor is zero or non-zero, applying the method according to the invention causes a reduction in the thickness of the fabric by homogenization of the thickness of the yarns making it up.

The invention is not limited to the described and illustrated examples since diverse modifications may be provided thereto without departing from its scope.

Examples of carbon yarn fabrics obtained by means of the method according to the invention are described in the examples hereafter.

MEASUREMENT METHODS USED

Measurements of the Thicknesses

I. The following equipment is used:

- Vacuum pump from Leybold systems vacuum pump with reference 501902
- Three-dimensional machine Tesa "micro-hite DCC 3D"
- A glazed plate in toughened glass, with a thickness of 8 mm
- A vacuum cover film with ref. 818260F 205° C. Nylon 6, green from the supplier Umeco, Aerovac.
- Bidim. AB1060HA 380 gsm 200° C. polyester, non-compressed rated thickness 6 mm, supplier Umeco Aerovac.
- PC with the software PC-Dmis V42
- A ball sensor ø3 with a maximum trigger of 0.06 N
- A cutting wheel of the Robuso type
- A cutting template 305×305 mm
- Connection for a vacuum pump
- A vacuum gasket SM5130 from the supplier Umeco Aerovac.

II. Description of the Measurement

- Put the glass plate with the stack of three pieces of a same fabric, as well as the environment, in the order from bottom to top:
  - Bidim (a felt known to one skilled in the art)
  - Stack of fabrics in the same direction, with the warp yarns extending in the direction parallel to an edge of the square of 305×305 mm
  - Vacuum cover
- Check the vacuum level (a vacuum of less than 15 mbars).
- Establish a pressure reduced by a minimum of 15 mbars in the vacuum cover, so as to place the stack under a pressure of 972 mbars+/−3 mbars.

Dimensional stabilization of the stack of fabrics under reduced pressure has to be attained.

Leave the stack under this reduced pressure for at least 30 minutes before taking the points.

Take a physical point on the table in a manual mode (white point on the top left of the table) by means of the joystick (joy on the stick), validate and then switch to automatic mode (auto on the stick):

Switch to automatic mode and wait till the measurement is made.

The program proceeds with taking 25 measurement points by means of its triggering sensor.

The measurement of 25 « blank» points is repeated i.e. without the stack of the three fabrics in order to measure the thickness of the vacuum cover and of the glass.

Thus by a differential altitude measurement in between, with or without a stack, we have a thickness average on 25 points, on the stack.

Openness Factor Measurements

The openness factors were measured according to the following method.

The device consists of a camera of the brand SONY (model SSC-DC58AP), equipped with a 10× objective and with a luminous table of the brand Waldmann, model W LP3 NR,101381 230V 50 Hz 2×15 W. The sample to be measured is laid on the luminous table, the camera is attached a bracket, and positioned at 29 cm from the sample, then the sharpness is adjusted.

The measurement width is determined according to the textile fabric to be analysed, by means of the ring (zoom), and of a ruler: 10 cm for open textile fabrics (OF>2%), 1.17 cm for not very open textile sheets (OF<2%).

By means of the diaphragm and of a control photograph, the luminosity is adjusted so as to obtain an OF value corresponding to the one given on the control photograph.

The contrast measurement software package Videomet, from Scion

Image (Scion Corporation, USA) is used. After capturing the image, the latter is processed in the following way: by means of a tool, a maximum surface area is defined corresponding to the selected calibration, for example for 10 cm-70 holes, and including an integer number of patterns. An elementary surface in the textile sense of the term, i.e. a surface which describes the geometry of the fabric by repetition is then selected.

The light of the luminous table passing through the apertures of the fabric, the OF as a percentage is defined by a hundred multiplied by the ratio between the white surface area divided by the total surface area of the elementary pattern: 100*(white surface/elementary surface).

It should be noted that the adjustment of the luminosity is important since diffusion phenomena may modify the apparent size of the holes and therefore the OF. An intermediate luminosity will be retained, so that no too significant saturation or diffusion phenomenon is visible.

The fabrics with a width of 127 cm having basis weights, thickness standard deviations, openness factor, openness factor variability and shown in Table 2 below were able to be obtained by means of the method according to the invention, by using the parameters as defined in Table 1.

Figure 5:
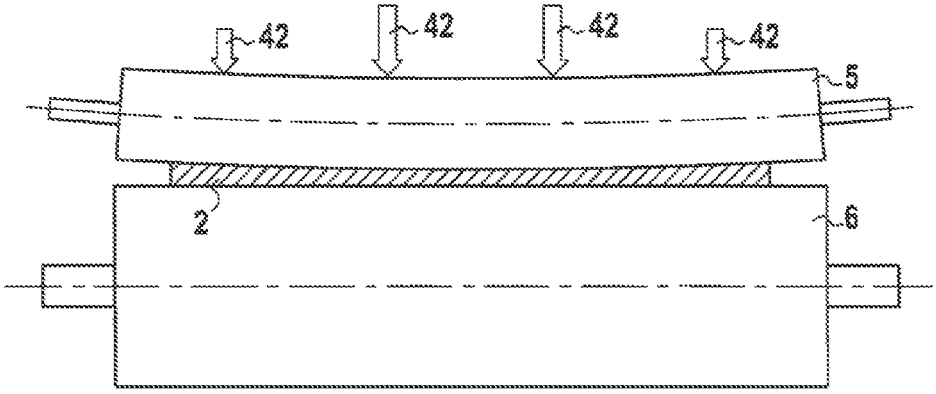
FIG. 5 is a view giving the possibility of schematically illustrating the spreading principle applied by the spreading machine according to the invention.

The machine used complies with FIGS. 1 and 2, with rollers of a diameter of 60 mm and a length of 1,700 mm, the actuators being spaced apart by 320 mm, the two located at the ends being distant from the edge of the fabric by 155 mm. Table 1 gives as an example, for the fabrics shown in Table 2, the pressure force of the 4 pressure actuators 44 (No. 1 to 4) taken from one edge to the other of the fabric, with a running speed of the textile sheet (mm/min), a frequency (Hz) and a temperature (° C.). According to these exemplary embodiments, more significant forces are applied in the central area of the fabric 2 allowing good spreading of the fabric 2, by compensating for the thickness difference existing initially between the centre and the edges of the fabric, as illustrated in FIG. 5.

The AS4 3K yarns provided by Hexcel Corporation (Stamford USA) are high breaking stress resistance yarns of 4,433 Mpa, of a tensile modulus of 231 GPa having a titer of 200 Tex with filaments of 7.1 microns.

The AS4 12K yarns provided by Hexcel Corporation (Stamford USA) are high breaking stress resistance yarns of 4,433 Mpa, of tensile modulus of 231 GPa having a titer of 800 Tex with filaments of 7.1 microns.

The AS7 12K yarns provided by Hexcel Corporation (Stamford, USA) are high breaking stress resistance yarns of 4,830 Mpa, of tensile modulus of 241 GPa and having a titer of 800 Tex with filaments of 6.9 microns.

The IM7 6K yarns provided by Hexcel Corporation (Stamford, USA) are yarns with an intermediate breaking stress modulus of 5,310 Mpa, of a tensile modulus of 276 Gpa and having a titer of 223 Tex with filaments of 5.2 microns.

The IM7 12K yarns provided by Hexcel Corporation (Stamford, USA) are yarns with an intermediate breaking stress module of 5,670 Mpa, of a tensile modulus of 276 Gpa and having a titer of 446 Tex with filaments of 5.2 microns.

As an example, the tissue of 199 g/m$^2$ with AS4 3K before spreading has an average openness factor of 10.5% (12.5% on the edges of the fabric, 6.5% on the centre of the fabric) i.e. a variation of 6% of the openness factor between centre and edge, and an average thickness of 0.191 mm (0.201 mm on the edges of the fabric, 0.187 mm on the centre of the fabric) i.e. a 12% thickness variation between centre and edge. The thickness standard deviation of the stack of three folds of the non-spread fabric is 0.055 mm.

After spreading out, the openness factor of this same fabric passes to 0.1% on average, i.e. a 99% reduction as compared with the non-spread out fabric, with a maximum variation of 0.5% which moreover is not due to an increase in the values on the edges, the average openness factor of the edges and of the centre being equal to 0.1%. A large portion of the measured openness factors are close to 0%, and a small population above 0.1% up to 0.5% in rare cases, inducing an average at 0.1% with a maximum variation of 0.5%. The thickness of the fabric after spreading is 0.177 mm, i.e. reduced by 8% as compared with the non-spread fabric. The standard deviation of the stack of three folds of the spread fabric is 0.030 mm, i.e. a 45% gain as compared with the non-spread fabric. This information is gathered in Table 3 hereafter.

As an another example, a tissue of 75 g/m$^2$ in AS4C 3K will have an average openness factor before spreading of 45%, and an average openness factor after spreading of 0.8%, i.e. a 98% gain.

In every case, the application of the method according to the invention causes a significant reduction in the standard deviation of the thickness, of the average thickness, of the openness factor and of its variability. In particular, regardless of the basis weight of the fabric and the yarn used, by applying the method according to the invention, the gain in thickness standard deviation of 3 folds under the pressure of 972 mbars is equal at least to 20%, and in most cases is greater than 30%.

TABLE 1

| | Warp and Weft Density | | Yarn titer | Actuator pressure force (N) | | | | Speed | Frequency | Temperature |
|---|---|---|---|---|---|---|---|---|---|---|
| | yarns/cm | Material designation | Tex | No. 1 | No. 2 | No. 3 | No. 4 | mm/min | Hz | ° C. |
| 75 g/m$^2$-IM7 6K-Web | 1.88 | IM7GP 6K HSCP5000 | 223 | 200 | 400 | 400 | 200 | 420 | 17 | 55 |
| 75 g/m$^2$-AS4 3K-Web | 1.88 | AS4GP 3K HSCP5000 | 200 | 200 | 400 | 400 | 200 | 420 | 17 | 55 |
| 98 g/m$^2$-IM7 6K-Web | 2.2 | IM7GP 6K HSCP6000 | 223 | 200 | 400 | 400 | 200 | 340 | 17 | 55 |
| 98 g/m$^2$-AS4 3K-Web | 2.45 | AS4GP 3K HSCP5000 | 200 | 200 | 400 | 400 | 200 | 340 | 17 | 55 |
| 160 g/m$^2$ IMA 12 K-Web | 1.79 | IMAGS 12K HSCP6000 | 446 | 400 | 500 | 500 | 400 | 417 | 27 | 55 |
| 199 g/m$^2$ AS4 3K-Web | 4.98 | AS4GP 3K HSCP5000 | 200 | 200 | 400 | 400 | 200 | 500 | 17 | 55 |
| 199 g/m$^2$-AS4 12K-Web | 1.24 | AS4GP 12K HSCP3000 | 800 | 200 | 400 | 400 | 200 | 600 | 40 | 55 |
| 300 g/m$^2$-AS7 12K-Twill 2/2 | 1.24 | AS7GP 12K HSCP4000 | 800 | 200 | 400 | 400 | 200 | 600 | 40 | 55 |

TABLE 2

| | Thickness (mm) | | | Openness Factor (%) | |
|---|---|---|---|---|---|
| | Average of the 3 fold stack | Standard deviation of the 3 fold stack | Average thickness per fold | Average | Variability |
| 75 g/m$^2$ - IM7 6K - Web | 0.169 | 0.023 | 0.056 | 0.2 | 0.5 |
| 75 g/m$^2$ - AS4 3K - Web | 0.145 | 0.028 | 0.048 | 0.8 | 0.8 |
| 98 g/m$^2$ - AS4 3K - Web | 0.232 | 0.025 | 0.077 | 0.6 | 0.6 |
| 98 g/m$^2$ - IM7 6K - Web | 0.222 | 0.024 | 0.074 | 0.1 | 0.5 |
| 160 g/m$^2$ - IMA 12K - Web | 0.340 | 0.046 | 0.113 | 0.4 | 0.4 |
| 199 g/m$^2$ - AS4 3K - Web | 0.531 | 0.030 | 0.177 | 0.1 | 0.5 |
| 199 g/m$^2$ - AS4 12K - Web | 0.446 | 0.038 | 0.149 | 0 | 0.1 |
| 300 g/m$^2$ - AS7 12K - Twill 2/2 | 0.742 | 0.078 | 0.247 | 0 | 0.1 |

TABLE 3

| | Thickness (mm) | | | | | | Openness Factor (%) | | |
|---|---|---|---|---|---|---|---|---|---|
| | Measured average thickness per fold on a stack of three folds | | | Standard deviation of the stack of three folds | | | Average | Maximum variability | |
| | Before spreading | After spreading | Gain | Before spreading | After spreading | Gain | Before spreading | After spreading | Gain |
| 199 g/m$^2$ AS4 3K-Web | 0.191 | 0.177 | 8% | 0.055 | 0.030 | 45% | 10.5 | 0.1 | 99% |

The invention claimed is:

1. A method for spreading a textile sheet including at least warp yarns, said method comprising the steps of:

passing a textile sheet that includes at least warp yarns between at least two rollers, the axes of which extend parallel to one another and substantially perpendicular to the direction of travel of the textile sheet; and applying pressure to the textile sheet by using at least one pressure generator to apply pressure to one of the rollers and driving the two rollers into axial oscillation and in phase opposition, wherein at least one of said pressure generators has adjustable pressure values for spreading the textile sheet to form a spread textile sheet having a low thickness variability.

2. The method according to claim 1, wherein one of the rollers is flexible and one of the rollers is rigid and wherein said at least one pressure generator is used to apply pressure to the flexible roller.

3. The method according to claim 2, wherein said pressure generator comprises a localized support located along the axis of the flexible roller and wherein the step of applying pressure to the textile sheet includes the step of adjusting the position of the localized support along the axis of the flexible roller.

4. The method according to claim 3 which includes the step of regularly distributing the localized supports along the axis of the flexible roller.

5. The method according to claim 3, which includes the step of distributing the localized supports at most over the whole of the width of the textile sheet.

6. The method according to claim 2, wherein said flexible roller has a periphery and wherein said textile sheet is passed between said flexible roller and two rigid rollers so that said textile sheet is passed over a portion of the periphery of the flexible roller.

7. The method according to claim 6, wherein the portion of the periphery of the flexible roller over which the textile sheet is passed is between ⅙ and ⅓ of the periphery of the flexible roller.

8. The method according to claim 1 which includes the step of heating the textile sheet as said textile sheet is passed between the rollers.

9. The method according to claim 1 wherein said textile sheet includes a fabric including warp yarns and weft yarns each consisting of a set of filaments which may move freely relatively to each other within said yarn.

10. The method according to claim 1, wherein said textile sheet has thickness differences, said method including the step of adjusting the pressure value of said at least one pressure generator in order to apply a uniform pressure on the textile sheet taking into account the thickness differences of the sheet.

11. A machine for spreading a textile sheet comprising at least warp yarns, said machine comprising:

at least two rollers, the axes of which extend parallel to each other and between which said textile sheet is passed;

a motor drive for rotating at least one roller about the axis of said roller;

a system for driving the at least two of said rollers in axial oscillation in phase opposition; and at least one pressure generator for applying pressure to one of the at least two rollers wherein at least one of said pressure generators has adjustable pressure values for spreading the textile sheet to form a spread textile sheet having a low thickness variability.

12. The spreading machine according to claim 11, wherein one of the rollers is flexible and one of the rollers is rigid and wherein said at least one pressure generator is used to apply pressure to the flexible roller.

13. The spreading machine according to claim 12, wherein said pressure generator comprises a localized support located along the axis of the flexible roller and a device for adjusting the position of said localized support along the axis of the flexible roller.

14. The spreading machine according to claim 12, wherein the at least one pressure generator applies pressure on the flexible roller, via a rolling member.

15. The spreading machine according to claim 12, which comprises said flexible roller and two rigid rollers.

16. The spreading machine according to claim 11, wherein the at least two rollers each have a diameter of between 30 mm and 60 mm.

17. The spreading machine according to claim 12, which includes for each rigid roller a series of rigid supports each including a cradle attached to a chassis and having two supporting branches each equipped with a rolling member.

18. The spreading machine according to claim 12, wherein the system for driving the at least two rollers into axial oscillation and in phase opposition includes a motor synchronously driven by a transmission, two camshafts shifted by 180°, one of which acts on one of the ends of the flexible roller and the other one acts on one of the ends of the rigid roller.

19. The spreading machine according to claim 18 wherein the one end of the flexible roller comprises a plate on which one of the two camshafts acts.

20. The spreading machine according to claim 11, which includes a system for heating the textile sheet upon passing of the textile sheet between the at least two rollers.

* * * * *